US006620212B1

(12) United States Patent
Handermann et al.

(10) Patent No.: US 6,620,212 B1
(45) Date of Patent: Sep. 16, 2003

(54) METHOD OF DYEING A CORESPUN YARN AND DYED CORESPUN YARN

(75) Inventors: Alan C. Handermann, Asheville, NC (US); David W. Shaw, Huntersville, NC (US); William P. Cochran, Concord, NC (US); William R. Bryant, Charlotte, NC (US); Frank J. Land, Island Park, NY (US)

(73) Assignees: McKinnon-Land, LLC, Charlotte, NC (US); BASF Corporation, Enka, NC (US); DyStar, L.P., Charlotte, NC (US)

( * ) Notice: Subject to any disclaimer, the term of this patent is extended or adjusted under 35 U.S.C. 154(b) by 0 days.

(21) Appl. No.: 09/679,357

(22) Filed: Oct. 5, 2000

Related U.S. Application Data

(60) Provisional application No. 60/234,359, filed on Sep. 22, 2000.

(51) Int. Cl.[7] ..... D06P 3/82; D06P 3/84; D06P 3/85

(52) U.S. Cl. ..... 8/529; 8/522; 8/523; 8/585; 8/587; 428/370; 428/373; 428/377

(58) Field of Search ..... 8/529, 523, 585, 8/587, 522; 428/370, 373, 377

(56) References Cited

U.S. PATENT DOCUMENTS

| | | | |
|---|---|---|---|
| 1,841,024 | A | 1/1932 | Garey et al. |
| 3,366,001 | A | 1/1968 | Meserole |

(List continued on next page.)

FOREIGN PATENT DOCUMENTS

| | | |
|---|---|---|
| GB | 1 593 048 | 7/1981 |
| JP | 57-059 585 | 4/1982 |
| JP | 58-100 323 | 6/1983 |
| JP | 60 107 608 | 6/1985 |
| JP | 61 261 330 | 11/1986 |
| JP | 1-141 041 | 6/1989 |

OTHER PUBLICATIONS

International Search Report issued in Application No. PCT/US01/29282, Dec. 2001.

*Primary Examiner*—Margaret Einsmann
(74) *Attorney, Agent, or Firm*—Burns, Doane, Sweckers & Mathis, L.L.P.

(57) ABSTRACT

Provided is a novel method of dyeing a corespun yarn which comprises an inorganic fiber core and at least a first sheath. The method comprises: (a) contacting the corespun yarn with a dye liquor; (b) heating the dye liquor to a dyeing temperature for a time effective to dye the yarn; (c) cooling the dye liquor at a controlled rate; and (d) rinsing the yarn with water or with a mixture comprising the dye liquor and water. The dyed corespun yarn has a strength retention of about 80% or more based on the undyed yarn. The methods in accordance with the invention allow for the formation of uniformly dyed, high strength corespun yarns. Also provided is a dyed, corespun yarn which can be made by the inventive method, a fabric formed from the corespun yarn, as well as a product upholstered with the fabric. The dyed yarns exhibit substantially no "grin through" and little to no yarn strength loss after dyeing.

20 Claims, 2 Drawing Sheets

U.S. PATENT DOCUMENTS 3,439,491 A 4/1969 Scruggs
3,572,397 A 3/1971 Austin
3,729,920 A 5/1973 Savers et al.
3,828,544 A 8/1974 Alker
3,886,015 A 5/1975 Turner
3,913,309 A 10/1975 Chiarotto
4,024,700 A 5/1977 Drummond
4,263,777 A 4/1981 Wada et al.
4,299,884 A 11/1981 Payen
4,331,729 A 5/1982 Weber
4,381,639 A 5/1983 Kress
4,497,167 A 2/1985 Nakahara et al.
4,500,593 A 2/1985 Weber
4,502,364 A 3/1985 Zucker et al.
4,534,262 A 8/1985 Swenson
4,541,231 A 9/1985 Graham, Jr. et al.
4,551,887 A 11/1985 Uematsu
4,557,972 A 12/1985 Okamoto et al.
4,640,179 A 2/1987 Cameron
4,670,327 A 6/1987 Weber
4,718,225 A 1/1988 Sanagi
4,868,041 A 9/1989 Yamagishi
4,921,756 A 5/1990 Tolbert et al.
4,927,698 A 5/1990 Jaco et al.
4,936,085 A 6/1990 Kolmes et al.
4,958,485 A 9/1990 Montgomery et al.
5,496,625 A 3/1996 Lilani
5,540,980 A 7/1996 Tolbert et al.
5,597,649 A 1/1997 Sandor et al.
5,688,594 A 11/1997 Lichscheidt et al.
5,849,648 A 12/1998 Kent et al.
5,891,813 A 4/1999 Gadoury
6,146,759 A 11/2000 Land
6,240,716 B1 6/2001 Yanagawase et al.
6,287,690 B1 9/2001 Land

METHOD OF DYEING A CORESPUN YARN AND DYED CORESPUN YARN

CROSS REFERENCE TO RELATED APPLICATIONS

This application claims the benefit of priority under 35 U.S.C. §119(e) of Provisional Application No. 60/234,359; Attorney Docket No. 015452-012, filed Sep. 22, 2000, the entire contents of which are incorporated herein by reference.

BACKGROUND OF THE INVENTION

1. Field of the Invention

The invention relates to methods of dyeing corespun yarn having an inorganic fiber core, and to dyed corespun yarns which can be formed by the inventive methods. The dyed corespun yarns of the invention are uniform in color and have a high strength retention. They have particular applicability in the formation of fabrics for applications such as upholstery, mattress and pillow ticking, bed spreads, pillow covers, draperies or cubicle curtains, wallcoverings, window treatments and clothing.

2. Description of the Related Art

The formation of single and multi-corespun yarns in the textile industry is known. Such yarns have particular applicability in the formation of fabrics for applications such as upholstery, mattress and pillow ticking, bed spreads, pillow covers, draperies or cubicle curtains, wallcoverings, window treatments and clothing. FIG. 1 illustrates a known double corespun yarn 100 which is conventionally produced on an air jet spinning apparatus. Such an apparatus is commercially available, for example, from Murata of America, Inc. and Feherer AG, and is described in the literature. See, e.g., U.S. Pat. Nos. 5,540,980, 4,718,225, 4,551,887 and 4,497,167, the entire contents of which patents are incorporated herein by reference. The basic structure of the yarn 100 includes a multi-filament core 102 of a first material surrounded by a first sheath 104 of a second material, and a second sheath 106 of a third material surrounding the first sheath 104.

After fabrication of the yarn, a dyeing process is carried out to impart desired color characteristics to the yarn. Conventional dyeing processes include prescour, dyeing and washing off clear sequences. Applicants have discovered that the conventional dyeing process can result in problems which adversely affect coloration and strength characteristics of corespun yarns which contain an inorganic fiber core. The coloration problem resulting from a conventional dyeing process commonly called "grin-through," and is particularly noticeable for medium and deep color shades. Grin-through is observed when the filament core or portion thereof and/or the first sheath or inner sheath fibers appear as undyed areas and/or loops 108 which are visible on the surface of the yarn product. This undesired effect renders the yarn less suitable or unsuitable for high quality fabrics requiring consistent, uniformly dyed yarns. The problem is especially aggravated when trying to achieve medium to deep shade yarn colors which contrast heavily against light colored, undyed core filaments, for example, white glass filaments and/or undyed portions of the first sheath or inner sheath fibers. The dyed corespun yarns resulting from conventional dyeing processes can also have significantly reduced strength when compared with the undyed (greige) yarns. Losses of original greige yarn strength of about 50% have been observed, when utilizing conventional yarn dyeing processes and techniques.

Through the invention, the inventors have discovered that subjecting the corespun yarn to significant thermal stress or shock during the conventional dyeing process is likely to cause both poor coloration and low strength characteristics of the yarn. For example, in the conventional disperse process, the yarn is typically exposed to temperatures at or above the boiling point of water. After contact with the yarn for a desired period, the temperature of the dye liquor may be rapidly decreased, for example, at a rate of about greater than 10° F./min. The liquor is then drained from the system and then immediately followed with a cold water rinsing step. These steps of rapid cooldown/dropbath/cool rinse, can occur up to three times in the conventional dyeing process where prescour and reduction clear sequences are performed in addition to the dyeing sequence.

When the yarn is subjected to the conventional dyeing process, the differential shrinkage forces between the various fibers and filaments included in the yarn product can cause grin-through. The thermal stresses to which the yarn is subjected during the conventional dyeing process, particularly that due to rapid cooling of the yarn, can cause microcracking and microfracturing of the filaments making up the core 102. This is particularly problematic for yarns containing inorganic filament cores such as ceramic or glass cores. As a result of this microcracking and microfracturing, color uniformity and the filaments' ability to impart strength to the dyed yarn and ultimately in the final woven fabric product are significantly reduced.

SUMMARY OF THE INVENTION

To overcome or conspicuously ameliorate the disadvantages of the related art, it is an object of the present invention to provide a novel method of dyeing a corespun yarn which comprises an inorganic fiber core and at least a first sheath. The method comprises: (a) contacting the corespun yarn with a dye liquor; (b) heating the dye liquor to a dyeing temperature for a time effective to dye the yarn; (c) cooling the dye liquor at a controlled rate; and (d) rinsing the yarn with water or with a mixture comprising the dye liquor and water. The dyed corespun yarn has a strength retention of about 80% or more based on the undyed yarn. The methods in accordance with the invention allow for the formation of uniformly dyed, high strength corespun yarns. The dyed yarns exhibit substantially no "grin through" and little to no yarn strength loss after dyeing. The dyed yarns in accordance with the invention have a typical strength retention, as measured by ASTM D2256, of 80% or more, preferably 90% or more, and more preferably 95% or more.

In a particularly preferred aspect of the invention, the corespun yarn is a fire resistant corespun yarn. The fire resistant corespun yarn comprises, for example, a core of a high temperature resistant continuous filament comprising fiberglass, a first sheath of blended staple fibers surrounding the core, the fibers comprising modacrylic fibers and melamine fibers, and a second sheath of staple fibers surrounding the first corespun yarn.

It is a further object of the invention to provide dyed, corespun yarns made by the inventive methods.

It is a further object of the invention to provide a dyed, corespun yarn comprising an inorganic fiber core. The dyed, corespun yarn has a strength retention of about 80% or more compared with the undyed yarn.

It is a further object of the invention to provide a dyed, corespun yarn comprising an inorganic fiber core and at least a first sheath. The dyed, corespun yarn exhibits substantially no grin-through.

In accordance with yet another aspect of the invention, a fabric is provided. The fabric includes a substrate which comprises the dyed corespun yarn.

In accordance with yet another aspect of the invention, a product upholstered with the fabric is provided.

Other objects, advantages and aspects of the present invention will become apparent to one of ordinary skill in the art on a review of the specification, drawings and claims appended hereto.

BRIEF DESCRIPTION OF THE DRAWINGS

The objects and advantages of the invention will become apparent from the following detailed description of the preferred embodiments thereof in connection with the accompanying drawings, in which like numerals designate like elements, and in which.

DETAILED DESCRIPTION OF PREFERRED EMBODIMENTS OF THE INVENTION

The method for dyeing a corespun yarn in accordance with the invention can be applied to any type of sheath/core yarn, and is particularly applicable to those comprising an inorganic multifilament core and at least a first sheath. Typical materials include, for example, aramids. Typical inorganic materials for the core include, for example, ceramics, glass, carbon, steel and combinations thereof. Of these, glass fiber is particularly preferred. Various glasses include, for example, A-, AR-, C-, HS- and S-glass. The sheath materials can include, for example, cotton, wool, nylon, polyester, polyolefin, rayon, silk, mohair, cellulose acetate and blends thereof.

In accordance with a particularly preferred aspect of the invention, the corespun yarn is a flame retardant yarn, for example, a fire resistant corespun yarn as described in U.S. Pat. No. 6,146,759, to Land (U.S. application Ser. No. 09/406,732, Attorney Docket No. 015452-008, filed Sep. 28, 1999), the entire contents of which are incorporated herein by reference. That patent discloses a fire resistant corespun yarn which includes a two-plied core of a high temperature resistant continuous filament comprising fiberglass and a low temperature resistant continuous filament synthetic fiber selected from polyethylene, nylon, polyester and polyolefin. A first sheath of blended staple fibers including modacrylic fibers and melamine fibers surrounds the core. A second sheath of staple fibers surrounds the first corespun yarn. The core accounts for from about 15 to 35% by weight based on the total weight of the corespun yarn, and the second sheath accounts for from about 35 to 80% by weight based on the total weight of the corespun yarn.

Figure 2:
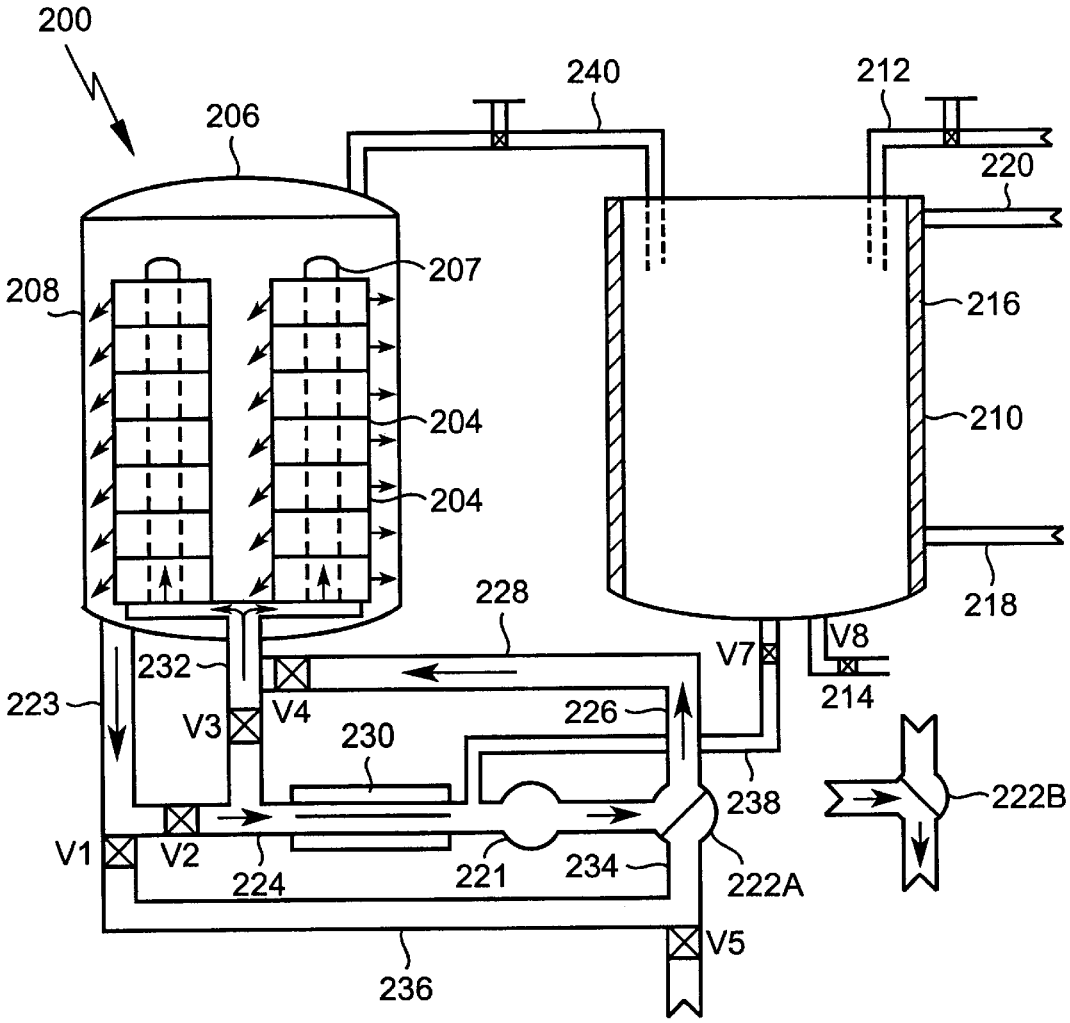
FIG. 2 is a schematic diagram of a package dyeing apparatus which can be used to practice the dyeing method according to the invention.

FIG. 2 illustrates an exemplary, preferred package dye treatment apparatus 200 commercially available from International Dyeing Equipment, Stanley, N.C. It is noted that the use of other types of dye treatment apparatuses such as a beam dyeing apparatus is envisioned, and that the specific dyeing method can be tailored to meet the requirements of such apparatuses.

The corespun yarn to be dyed is either taken up or rewound onto perforated dye tubes to produce yarn packages 204. The preferred package density is from about 0.30 to 0.35 g/cm$^3$, the preferred package weight is about 2.5 lbs. and the preferred package dimensions include an outside diameter of about 6.75 inches and an inside diameter of about 1.625 inches. After opening the top 206 of a kettle 208 in which the dye tubes 204 are to be placed, the yarn packages 204 are stacked on one another on plural rods 207, and the top 206 is closed. Rods 207 have perforations therein, for passing a treating fluid therethrough. The dye and other treatment chemicals including water are added to an expansion tank 210. A conduit and pumping system are provided for transporting the treatment chemicals through the system.

Connected to the expansion tank 210 are a process water introduction conduit 212 for introducing process water into the expansion tank, and a drain conduit 214 for emptying the contents of the tank. To control the temperature of the treatment liquid, a jacket heater 216 or other known temperature control means can be employed. In the case of a jacket heater, a heating fluid (e.g., steam) inlet 218 and outlet 220 are provided.

The apparatus 200 can be operated in two modes, i.e., in-to-out (I/O) and out-to-in (O/I) modes, which refers to the direction of flow of the treatment liquid into and out of the yarn packages 204. In operation, the apparatus can be run in I/O mode, in O/I mode or in an alternating I/O-O/I mode wherein each flow direction is performed for a desired period of time before switching to the opposite flow direction. The treatment liquid is transported through the system by use of a pump 221, and temperature of the liquid can be controlled by a heat exchanger 230 in conduit 224. Flow direction is controlled between I/O and O/I by control of a system of valves and a flow regulator which can be switched between an I/O position 222A and O/I position 222B.

The arrows show the direction of flow in the case of I/O flow. In I/O flow, the treatment liquid is introduced into the bottom of rods 207 and flows outward through the perforations into the yarn packages 204. The treatment liquid is withdrawn from the kettle 208 through conduit 223. With valves V1, V3 , V5 and V7 closed, and valves V2 and V4 open, the treatment liquid passes from conduit 223 through conduits 224, 226 and 228, and back into the bottom of rods 207.

In O/I mode, the treatment liquid flows through the system in a direction opposite to that in I/O mode. The treatment liquid flows into the kettle 208 through conduit 223. In the kettle, the treatment liquid flows inwardly through the yarn packages 204, through the perforations in rods 207 and out of the kettle through the bottom of the rods. With the flow regulator in the O/I position 222B, and valves VI and V3 open, and valves V2, V4, V5 and V7 closed, the treatment liquid passes from the kettle through conduits 232, 224, 234, 236 and 223, and is returned to the kettle.

The treatment liquid in expansion tank 210 can be introduced into the kettle in either I/O or O/I mode by opening valve V7 such that the liquid passes through conduit 238 to conduit 224, and operating as described above. The treatment liquid in the kettle 208 can be introduced into the expansion tank 210 through conduit 240. The apparatus can be automatically controlled by use of a suitable controller. The flow direction is typically controlled by a timer, with the setting depending, for example, on the fiber and dyeing system being used.

For purposes of the following discussion, it is noted that measurements for the dyeing and prescour steps are set forth in a liquor to goods ratio unless otherwise stated.

1. Prescour Treatment

Prior to the dyeing sequence, the corespun yarn is preferably subjected to a prescour treatment to remove manufacturer applied spin finishes from the yarn. The spin finishes can include, for example, waxes, oils, antistatic agents and lubricants applied to the fibers, filaments or yarn during the yarn manufacturing process.

A bath is made in the kettle 208 by introducing therein process water, preferably deionized water, typically at a temperature of from about 50 to 140° F., preferably from about 80 to 120° F. Preferably, the water is set to continuously flow into and out of the kettle 208 such that the flow direction alternates between I/O and O/I, the periods for each being set for a predetermined period of time. This type of flow sequence is preferably employed through the prescour process as well as the other processes described below, unless otherwise specified. Typically, I/O flow is set for a period of time of from about 2 to 4 minutes, and the O/I flow is set for a period of time of from about 3 to 6 minutes.

A low foaming detergent, preferably an anionic surfactant such as KIERALON MFB or JET B, manufactured by BASF Corp., and caustic (50% NaOH) is added to the water. The detergent is preferably added in an amount of from about 0.5 to 1.5 g/l, and the caustic is typically added in an amount of from about 1 to 7 wt %, preferably from about 3 to 6 wt %, more preferably about 5 wt %, based on the yarn. The scour mixture is then heated to a temperature typically of from about 140 to 220° F., preferably about 180° F., and run at that temperature for from about 5 to 30 minutes, preferably from about 10 to 20 minutes, more preferably about 15 minutes.

After contacting the yarn with the detergent and caustic soda, the yarn is rinsed preferably using an I/O flow of the liquid, and impurities can thereby be removed from the kettle 208. The rinsing process can be carried out by gradually reducing the temperature of the bath to the temperature of the process water. The detergent bath is then drained from vessel 208, fresh process water is added, and the corespun yarn is rinsed and the bath drained. Advantageously, a "running rinse" can be employed to rinse the corespun yarn. In the running rinse, the process (rinse) water which is at a temperature lower than the treatment liquid is added without draining the bath. Rinsing is continued and the bath temperature is allowed to fall gradually to the temperature of the process water. The bath is completely drained after the running rinse.

2. Dyeing Treatment

Following the optional prescour treatment, the corespun yarn is subjected to a dyeing sequence. Fresh process water is introduced into the kettle 208 and, preferably, an I/O-O/I flow sequence is started having the same time periods as described above with reference to the prescour treatment.

If the process water has a high metal ion content, it is preferable to add a sequestering agent, for example, EDTA or DPTA, sequester the metal ions. If left untreated, the calcium ions can inhibit the dye shade color. To avoid such problem, the process water is preferably deionized water.

Preferably, a carrier is next introduced into the process water in an amount typically from about 5 to 20 wt %, preferably about 10 wt % of the goods. The purpose of the carrier is to plasticize the yarn. The carrier diffuses into the pores of the yarn and acts as a swelling agent such that the dye can diffuse into the fibers of the yarn. The carrier is particularly useful for deeper colored dyes such as navy blue and black. The carrier is selected based on the properties of the outermost sheath fibers. Suitable carriers include, for example, dimethyl phthalates (e.g., CHEMOCARRIER KD5W, available from Sybron Chemical Corp.), aryl ethers (e.g., CINDYE C-45, available from Stockhausen) and benzyl alcohols.

The water optionally including the sequestering agent and carrier is next heated to a temperature typically from about 130 to 150° F., preferably about 140° F. Excessively high temperatures are to be avoided as gelling of the dye can occur if the temperature is too high.

A disperse dye predispersed in water, typically from about 1:20 parts dye:water, is added typically at a temperature of from about 110 to 130° F., preferably about 120° F. to prevent gelling of the dye. The specific dye and temperature selected are those preferred for the outermost sheath fibers. For example, a disperse dye can be used for polyesters, a reactive dye for rayon and cotton, and an acid dye for nylon and polyesters. Typical dyes which can be employed include, for example, a mixture of disperse dyes, predispersed in water. Suitable dyes and concentrations are known to persons of ordinary skill.

The typical pH range for optimum dyeing is from 4 to 9, preferably from 4 to 6. The pH of the dyeing liquor should be checked and adjusted with, for example, acetic acid or soda ash if needed. The dyeing liquor is heated to a desired dye temperature, typically from about 200 to 275° F., preferably from about 220 to 240° F., at a controlled rate. This rate is typically from about 1 to 6° F./minute, preferably from about 2 to 3° F./minute. Once the target dyeing temperature is reached, the temperature is held for a desired time period, typically from about 15 to 60 minutes. The dyeing temperature and time period are interrelated, as dyes penetrate faster at higher temperatures. Thus, shorter time periods are required for higher temperatures.

After dyeing for the desired period of time, the dye liquor is cooled to a temperature of from about 140 to 170° F., preferably about 160° F., at a controlled rate to minimize fiber shrinkage and maintain yarn strength. Cooling in such a manner will help to prevent microcracking and microfracturing of the yarn core. While the optimal rate of cooling will depend on the specific yarn materials, the rate is typically from about 2 to 6° F./minute, preferably from about 2 to 4° F./minute).

After the dye liquor cooling step, a rinsing step is performed to wash the dyed yarn. If a water supply at or around the temperature of the cooled dye liquor is available, the dye bath can be drained and the water introduced into the kettle 208. If such a water supply is not available, a running rinse as described above with reference to the prescour treatment can be employed. The final temperature of the bath will be around that of the process water, typically from about 50 to 140° F., preferably from about 80 to 120° F.

To help ensure that excess dye chemical has been removed from the yarn, the kettle can be drained, and one or more additional rinses with fresh process water can optionally be carried out. In these rinses, the water is preferably heated if necessary to a temperature, for example, of from about 110° F. to 150° F., preferably about 140° F., for a period of from about 3 to 10 minutes, preferably two cycles of reverse flow.

3. Reduction Clear Treatment

An additional, optional sequence in the dyeing process with disperse dyes which takes place subsequent to the above-described dyeing sequence is called reduction clear. In the reduction clear sequence, residual dye not fully diffused in the fibers of the yarn is removed. The reduction clear sequence is preferably used for deep shade colors in which the dye is used in amounts greater than 1 wt % based on the total weight of the yarn. Where reduction clear is not employed for heavy shades, the presence of loose dye will reduce the fastness of the fabric to wet treatments or rubbing (crocking).

If the treatment liquid has been previously drained from the apparatus, a fresh bath is made in the kettle 208 by introducing therein process water. Preferably, the bath in the kettle is set to continuously flow into and out of the kettle 208 such that the flow direction alternates between I/O and O/I, for the time periods as previously discussed. A scouring agent, typically an anionic surfactant such as UNIPEROL EL, available from BASF, is added to the vessel 210. The scouring agent is typically added in an amount of from about 0.5 to 1.5 g/l, preferably about 1 g/l. This is followed by addition of a 50% caustic soda liquor in an amount typically of from about 3 to 6 g/l, preferably about 4.5 g/l, and then sodium a reduction chemical, for example, hydrosulfite or thiourea dioxide, in an amount typically of from about 3 to 6 g/l, preferably about 4 g/l. The reduction clear treatment liquid is then heated to a suitable clearing temperature, typically from about 160° F. to 180° F., and the yarn is processed at that temperature for a desired time, typically from about 10 to 20 minutes.

The reduction clear liquid is next cooled to a temperature of from about 140° F. to 170° F., preferably about 160° F., at a controlled rate at a controlled rate. This rate is typically from about 2 to 6° F./minute, preferably from about 2 to 5° F./minute. A running rinse is then performed with process water to cool the liquid to about the process water temperature, preferably from about 80° F. to 120° F. The kettle is then drained and refilled with water, and heated to a temperature of from about 110° F. to 130° F., preferably about 120° F. The bath is neutralized to a pH of about 7, typically with about 1 g/l acetic acid. A running rinse is performed for from about 7 to 15 minutes, preferably about 10 minutes, and the kettle is drained.

In an alternative exemplary embodiment for the reduction clear treatment, after the dyeing liquor has been cooled in the dyeing treatment sequence, CYCLANON ECO, available from BASF, can be added in an amount of from about 2 to 6 g/l, preferably about 3 g/l, and the yarn is treated for a period of from about 10 to 20 minutes. The bath can then be drained. In this embodiment, the neutralization step can be eliminated. However, before adding the chemical, the pH should be from 4 to 5.

The kettle lid 206 is next raised and the dye tubes 204 are removed from the apparatus. Water is extracted from the yarn and the yarn is dried, for example, by a hot air blower which blows in a direction from inside to outside of the dye tubes until the yarn is dried.

The obtained dyed corespun yarns can advantageously be used in forming fine textured decorative fabrics for numerous applications, such as upholstery, mattress and pillow ticking, bed spreads, pillow covers, draperies or cubicle curtains, wallcoverings, window treatments and clothing, particularly baby clothing. In accordance with a preferred aspect of the invention, the dyed corespun yarn is flame retardant yarn such as disclosed in the previously referenced U.S. Pat. No. 6,146,759, to Land (U.S. application Ser. No. 09/406,732, Attorney Docket No. 015452-008, filed Sep. 28, 1999), dyed by the above-described methods.

Fabrics formed with the dyed flame retardant yarns have the feel and surface characteristics of similar types of upholstery fabrics formed of 100% polyolefin fibers while having the desirable fire resistant and flame barrier characteristics not present in upholstery fabric formed entirely of polyolefin fibers. In this regard, the fabrics formed with such dyed flame retardant yarns in accordance with the invention meet various standard tests designed to test the fire resistancy of fabrics, e.g., Technical Bulletin, California 133 Test Method (Cal. 133) (Upholstery), the entire contents of which are herein incorporated by reference. According to this test, a composite manufactured chair upholstered with a fabric to be tested is exposed to an 80 second inverted rectangular Bunsen burner flame. Fabrics employing the above-described fire resistant multi-spun yarn having gone through this test remain flexible and intact, exhibiting no brittleness, melting, or fabric shrinkage. Additional tests which the formed fabrics meet include Cal 129 (Mattress), Boston Fire Code 911 (Mattress), the proposed Consumers Product Safety Commission (CPSC) Proposed Flammability Code, CPSC modified version of BS 5852, the Component Testing on Chair Contents (Britain, France, Germany and Japan) and the Component Testing on Manufactured Chair (Britain, France, Germany and Japan).

Figure 1:
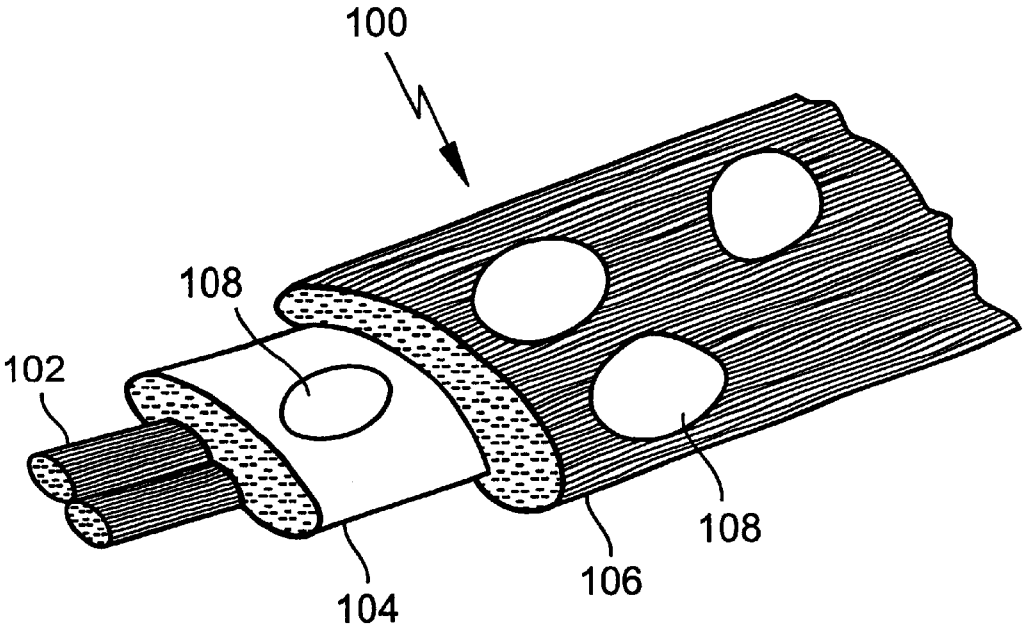
FIG. 1 is an enlarged view of a fragment of a double corespun yarn of the related art.
Figure 3:
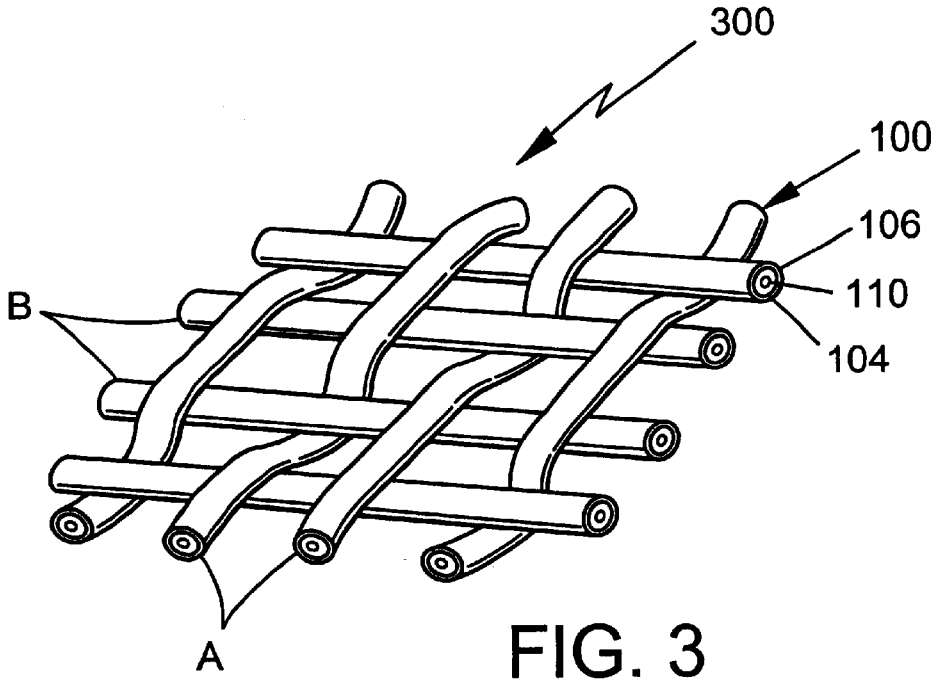
FIG. 3. is a fragmentary isometric view of a portion of a woven fabric in accordance with invention.

FIG. 3 illustrates an enlarged view of a portion of an exemplary woven decorative fabric 300 in a two up, one down, right-hand twill weave design. In this exemplified embodiment, the dyed corespun yarn is employed for warp yarns A. The material for the filling yarn can be the same or different from that of the warp yarn, depending on the second sheathing material. For purposes of illustration, an open weave is shown to demonstrate the manner in which the warp yarns A and the filling yarns B are interwoven. However, the actual fabric can be tightly woven. For example, the weave can include from about 10 to 200 warp yarns per inch and from about 10 to 90 filling yarns per inch.

While FIG. 3 illustrates a two up, one down, right-hand twill weave design, the described dyed multi-corespun yarns can be employed in any number of designs. For example, the fabric can be woven into various jacquard and doubly woven styles.

The following non-limiting examples are set forth to further demonstrate the method of making dyed corespun yarns in accordance with the present invention. The examples also demonstrate the excellent color uniformity and strength retention characteristics exhibited by these dyed corespun yarns.

EXAMPLES

Example 1

1. Fabrication of Fire Resistant Corespun Yam

One 99 denier multifilament glass strand (ECD 450 from PPG) was brought together with one end of 20 denier/8 filament multifilament nylon 6 (from BASF Corporation) as a dual core input into a Murata Air-Jet Spinning apparatus and wrapped with a 45 grain weight sliver consisting of a 50/50 blend of melamine fiber (Basofil fiber from BASF Corporation) and modacrylic fiber (PROTEX-M fiber from Kaneka Corporation) to produce a 26 cotton count sheath/core yarn (first process yarn).

A 10/1 cotton count yarn made with KoSa, (Charlotte, N.C.) (Type 121) staple polyester fiber (1.2 dpf×1.5 inch length) was next spun as a second sheath with a Fehrer AG (Linz, Austria) DREF2000 spinning apparatus over the first process yarn which was used as the core yarn.

2. Dyeing of Corespun Yarn

An International Dyeing Equipment dye treatment apparatus 200 as described above with reference to FIG. 2 was used to dye the corespun yarn 202 obtained as above. The corespun yarn 202 was wound onto dye tubes 204 at a package density of 0.32 g/cm$^3$, and a package weight of 2.3 lbs. The dye tubes 204 were stacked on the perforated rods 207 of the apparatus.

a. Scouring Treatment

The apparatus was filled with ambient process water at a temperature of about 70° F. The flow of the water was set to run alternately I/O for two minutes and O/I for five minutes. 1.5 g/l of KIERALON MFB (low foaming anionic detergent) and 5.0 ml/l (50%) caustic were added to the water, and the bath was heated to 160° F. and run at that temperature for 15 minutes. The flow direction was then set to I/O, and fresh process water was added for five minutes while performing a running rinse, thereby allowing the bath temperature to fall. The rinse water was then drained. The caustic was neutralized with 1.0 g/l acetic acid (56%).

b. Dyeing Treatment

The apparatus was filled with ambient process water at a temperature of about 70° F. The flow direction of the water was set to run alternately I/O for two minutes and O/I for five minutes. A carrier, CHEMOCARRIER KD5W (Sybron Chemical Corp.), was added in an amount of 10 wt % based on the weight of the yarn, and the bath was heated to 140° F. A mixture of 0.05 wt % Palanil Yellow E-3GE200, 0.06 wt % Palanil Red E-BF200, and 0.057 wt % Palanil Blue E-R disperse dyes, pre-dispersed in water (approximately 1 to 20 parts dye to water by weight) was added to the bath at 120° F. to form a dye liquor. The process was run for 5 minutes, adjusting the pH to 5 with acetic acid.

The dye liquor was heated to a dyeing temperature of 212° F. at a rate of 3° F./minute. After reaching the dyeing temperature, the yarn was treated for a period of 60 minutes. The dye liquor was then cooled down to 160° F. at a controlled rate of 3° F./minute. After cooling the dye liquor to 160° F., a running rinse was carried out by first setting the flow direction of the dye liquor to I/O, and adding ambient process water at about 70° F. for ten minutes, allowing the bath temperature to gradually fall. The liquid in the apparatus was drained after the running rinse.

c. Reduction Clear Treatment

The apparatus was refilled with ambient process water at about 70° F., and the flow direction was set to run alternately I/O for two minutes, and O/I for five minutes. 4.5 ml/l 50% caustic soda liquid was added to the water, followed by 4 g/l thiourea dioxide. The liquid was heated to 180° F. and the yarn was treated at that temperature for 15 minutes. The flow direction was then set to I/O and a running rinse was performed with ambient process water at about 70° F. for 10 minutes, allowing the bath temperature to gradually fall. The liquid in the kettle was then drained. The apparatus was refilled with the ambient process water, and the flow was set to run alternately I/O for 2 minutes, and O/I for 5 minutes. 1.0 g/l acetic acid was added to the water, and the bath was heated to 120° F. and run for 10 minutes at that temperature. The pH was checked to ensure it was maintained below 7. The flow direction of the liquid was set to I/O, and a running rinse was performed with process water at about 70° F. for 10 minutes, allowing the bath temperature to gradually fall. The liquid was drained from the kettle, and the yarn was extracted from the machine and hot air dried.

The dyed corespun yarn was tested for strength retention compared with the undyed yarn in accordance with ASTM D2256 (single strand method). The test results are shown below in Table 1.

Example 2

The procedure described above with reference to Example 1 was repeated except for the following. A mixture of 0.18 wt % Palanil Yellow E-3GE200, 2.20 wt % Palanil Red E-BF200, and 0.22 wt % Palanil Blue E-R disperse dyes, pre-dispersed in water (approximately 1 to 20 parts dye to water by weight) was added to the bath in place of the dye mixture of Example 1, and the dyeing temperature was 265° F. with a controlled (slow) cooldown rate ranging from 2 to 4° F./minute. The dyed corespun yarn was tested for strength retention compared with the undyed yarn as described above in Example 1. The test results are shown below in Table 1.

Example 3

The procedure described above with reference to Example 1 was repeated except for the following. A mixture of 1.80 wt % Dispersol Black C-VSE300 and 0.35 wt % Dispersol Yellow Brown C-VSE300 disperse dyes, pre-dispersed in water (approximately 1 to 20 parts dye to water by weight) was added to the bath in place of the dye mixture of Example 1, and the dyeing temperature was 265° F. with a controlled (slow) cooldown rate ranging from 2 to 4° F./minute. The dyed corespun yarn was tested for strength retention compared with the undyed yarn as described above in Example 1. The test results are shown below in Table 1.

Example 4 (Comparative)

The procedure described above with reference to Example 1 was repeated except for the following. A mixture of 0.013 wt % Palanil Yellow E-3GE200, 0.055 wt % Palanil Red E-BF200, and 2.0 wt % Palanil Blue E-R disperse dyes, pre-dispersed in water (approximately 1 to 20 parts dye to water by weight) was added to the bath in place of the dye mixture of Example 1, and the dyeing temperature was 212° F. with an uncontrolled (rapid) cooldown rate greater than 9° F./minute. The dyebath was immediately drained and refilled with ambient process water at about 70° F., according to a conventional procedure, and the reduction clear treatment is then carried out. The dyed corespun yarn was tested for strength retention compared with the undyed yarn as described above in Example 1. The test results are shown below in Table 1.

TABLE 1

| Example No. | Yarn/Dye | Breaking Load at Maximum | % of Control |
|---|---|---|---|
| — | 10/1 greige yarn control | 866 gm | — |
| 1 | 10/1 dyed tussah shade | 881 gm | 102% |
| 2 | 10/1 dyed maroon shade | 803 gm | 93% |
| 3 | 10/1 dyed black shade | 758 gm | 88% |
| 4 (Comp) | 10/1 dyed royal blue shade | 414 gm | 48% |

These results demonstrate that the corespun yarns dyed in accordance with the invention exhibit excellent strength retention when compared with the greige (undyed) yarn. In this regard, Examples 1–3 in accordance with the invention resulted in a breaking load at maximum of 102%, 93% and 88%, respectively, when compared with the undyed yarn. These results are significantly improved when compared with Example 4 (comparative), which employs a conventional dyeing procedure with a rapid cooldown rate, and a dropbath drain and cold fill rinse procedure.

Through the invention, a corespun yarn employing an inorganic core and at least a first sheath surrounding the core can be dyed with excellent color uniformity and strength retention characteristics. The dyed yarns in accordance with the invention have a typical strength retention, as measured by ASTM D2256, of 80% or more, preferably 90% or more, and more preferably 95% or more. The dyed corespun yarn can advantageously be employed in a fabric and a product upholstered with the product.

While the invention has been described in detail with reference to specific embodiments thereof, it will be apparent to one skilled in the art that various changes and modifications can be made, and equivalents employed, without departing from the scope the appended claims.

What is claimed is:

1. A method of dyeing a corespun yarn comprising an inorganic fiber core and at least a first sheath, comprising the steps of:

(a) contacting the corespun yarn with a dye liquor, (b) heating the dye liquor to a dyeing temperature for a time effective to dye the yarn;

(c) cooling the dye liquor at a controlled rate;

(d) rinsing the yarn with a rinsing liquid comprising water, and (e) removing residual dye not in the fibers of the yarn comprising contacting the yarn with a reduction dear liquid, wherein the dyed corespun yarn has a strength retention of about 80% or more based on the undyed yarn.

2. The method according to claim 1, wherein the method is carried out in a package dye machine or a beam dye machine.

3. The method according to claim 2, wherein step (b) is carried out with an alternating in-to-out/out-to-in flow of the dye liquor.

4. The method according to claim 2, further comprising, prior to step (a), a step ($a_0$) of prescouring the corespun yarn by contacting the corespun yarn with a prescouring liquid comprising a low foaming detergent.

5. The method according to claim 4, wherein the prescouring liquid further comprises caustic.

6. The method according to claim 4, further comprising, after step ($a_0$), a step ($a_1$) of cooling the prescouring liquid by adding water thereto in a running rinse.

7. A method of dyeing a corespun yarn comprising an inorganic fiber core and at least a first sheath, comprising the steps of:

(a) contacting the corespun yarn with a dye liquor;

(b) heating the dye liquor to a dyeing temperature for a time effective to dye the yarn;

(c) cooling the dye liquor at a controlled rate of from about 2 to 6° F./minute; and (d) rinsing the yarn with a rinsing liquid comprising water, wherein the dyed corespun yarn has a strength retention of about 80% or more based on the undyed yarn.

8. The method according to claim 1, wherein the reduction clear liquid comprises water and a reduction chemical.

9. The method according to claim 8, wherein the reduction chemical is sodium hydrosulfite or thiourea dioxide.

10. The method according to claim 8, further comprising, after step (e), a step (f) of cooling the reduction clear liquid by adding water thereto in a running rinse.

11. The method according to claim 1, wherein the dyeing liquor in step (c) is cooled at a rate of from about 2 to 6° F./minute.

12. The method according to claim 1, wherein the inorganic fiber core is made of a material selected from the group consisting of ceramics, glasses, carbons, steels and combinations thereof.

13. The method according to claim 1, wherein the corespun yarn is a fire resistant corespun yarn.

14. The method according to claim 13, wherein the fire resistant corespun yarn comprises:

a core of a high temperature resistant continuous filament comprising fiberglass;

a first sheath of blended staple fibers surrounding the core, the fibers comprising modacrylic fibers and melamine fibers; and a second sheath of staple fibers surrounding the first corespun yarn.

15. The method according to claim 1, wherein the dye liquor comprises a carrier effective to plasticize the fibers in the yarn.

16. The method according to claim 15, wherein the carrier is selected from the group consisting of dimethyl phthalates, aryl ethers and benzyl alcohols.

17. The method according to claim 1, wherein the dye liquor comprises a disperse dye.

18. The method according to claim 1, wherein the corespun yarn comprises a sheath made from a material selected from the group consisting of cotton, wool, nylon, polyester, polyolefin, rayon, silk, mohair, cellulose acetate and blends thereof.

19. A method of dyeing a corespun yarn comprising a fiber core and at least a first sheath, comprising the steps of:

(a) contacting the corespun yarn with a dye liquor;

(b) heating the dye liquor to a dyeing temperature for a time effective to dye the yarn;

(c) cooling the dye liquor at a controlled rate;

(d) rinsing the yarn with a rinsing liquid comprising water, and (e) removing residual dye not in the fibers of the yarn comprising contacting the yarn with a reduction clear liquid, wherein the dyed corespun yarn has a strength retention of about 80% or more based on the undyed yarn.

20. A method of dyeing a corespun yarn comprising a fiber core and at least a first sheath, comprising the steps of:

(a) contacting the corespun yarn with a dye liquor, (b) heating the dye liquor to a dyeing temperature for a time effective to dye the yarn;

(c) cooling the dye liquor at a controlled rate of from about 2 to 6° F./minute; and (d) rinsing the yarn with a rinsing liquid comprising water, wherein the dyed corespun yarn has a strength retention of about 80% or more based on the undyed yarn.

* * * * *